US005860657A

United States Patent [19]

Kroher

[11] Patent Number: 5,860,657

[45] Date of Patent: Jan. 19, 1999

[54] MANEUVERABLE SKATEBOARD-LIKE ROLLING DEVICE

[76] Inventor: Karl Kroher, Klostergasse 5, D-92711 Parkstein, Germany

[21] Appl. No.: 660,400

[22] Filed: Jun. 7, 1996

[30] Foreign Application Priority Data

| | | | |
|---|---|---|---|
| Jun. 9, 1995 | [DE] | Germany | 295 09 476 U |
| Jun. 24, 1995 | [DE] | Germany | 295 10 301 U |
| Oct. 14, 1995 | [DE] | Germany | 295 16 318 U |
| Dec. 7, 1995 | [DE] | Germany | 295 19 414 U |
| Dec. 22, 1995 | [DE] | Germany | 295 20 354 U |

[51] Int. Cl.[6] ..... A63C 17/02

[52] U.S. Cl. ..... 280/11.22; 280/87.042

[58] Field of Search ..... 280/11.2, 11.22, 280/11.23, 87.042, 87.041

[56] References Cited

U.S. PATENT DOCUMENTS

| | | | |
|---|---|---|---|
| 681,368 | 8/1901 | Kent | 280/11.23 |
| 2,097,721 | 11/1937 | Cledina | 280/11.2 |
| 3,876,217 | 4/1975 | Copier | 280/11.23 |
| 4,050,705 | 9/1977 | Kreis | 280/11.2 X |
| 4,168,076 | 9/1979 | Johnson | 280/11.2 |
| 4,394,029 | 7/1983 | Holmgren | 280/11.23 |
| 4,991,861 | 2/1991 | Carn et al. | 280/11.2 X |
| 5,160,155 | 11/1992 | Barachet | 280/87.042 |

*Primary Examiner*—Robert J. Oberleitner
*Assistant Examiner*—Pamela J. Lipka
*Attorney, Agent, or Firm*—Hoffman, Wasson & Gitler

[57] ABSTRACT

A skateboard-like rolling device with a frame, wheels on the front and back of the frame, the wheels being freely rotatable around two wheel axles and at least one standing area provided between the two wheel axles. The device has a rear wheel arrangement formed by at least two wheels that are offset to one another in a direction along their axles.

8 Claims, 6 Drawing Sheets

MANEUVERABLE SKATEBOARD-LIKE ROLLING DEVICE

BACKGROUND OF THE INVENTION

The invention relates to a skateboard-like rolling device. The rolling device includes: a frame; wheels provided on the front and back of the frame and freely rotatable around two wheel axles; and at least one standing area that is provided between the two wheel axles. The front wheel axle is designed as a steerable axle with a wheel suspension that is formed by a wheel suspension that is formed by a wheel fork that has two fork arms.

Such a device is, for example, an object of U.S. Pat. No. 5,160,155. Prior devices have many disadvantages including having low stability when getting onto the device at the beginning of a ride.

The object of the invention is to provide an improved device.

To achieve this object, a rolling device is designed, embodying the present invention, with a rear wheel arrangement formed by at least two wheels that are offset relative to one another in a direction along their axle.

SUMMARY OF THE INVENTION

The device according to the invention is distinguished by high stability when starting or getting onto the device, while offering a simple and sturdy design and high maneuverability and mobility during riding, i.e., the device does not have a tendency to tip over when getting on or first starting. This stability is due to the dual wheels at the back, which also ensure improved wheel grip. In a preferred embodiment, the steering axis at an imaginary plane lying parallel to the wheel axles encloses an angle of less than 90° that is open toward the front of the device. This also contributes to stability. The device is preferably provided with at least one spring device, by which the front wheel axle or the wheel suspension that is located there is preloaded for a steering maneuver. This has the decisive advantage that in an emergency, i.e., if the user of the device jumps or falls off, the device, despite its high stability, immediately tips over and comes to a standstill and thus does not keep going, out of control.

The device according to the invention is also suitable especially for surfing away the water or on land, for example on the sand or secured surfaces and also for riding down sloping or inclined terrain, on paths, streets, etc.

Further developments of the invention are the object of the subclaims.

BRIEF DESCRIPTION OF THE FIGURES

The invention is explained in more detail below based on the figures in embodiments.

DETAILED DESCRIPTION OF THE INVENTION

Figure 1:
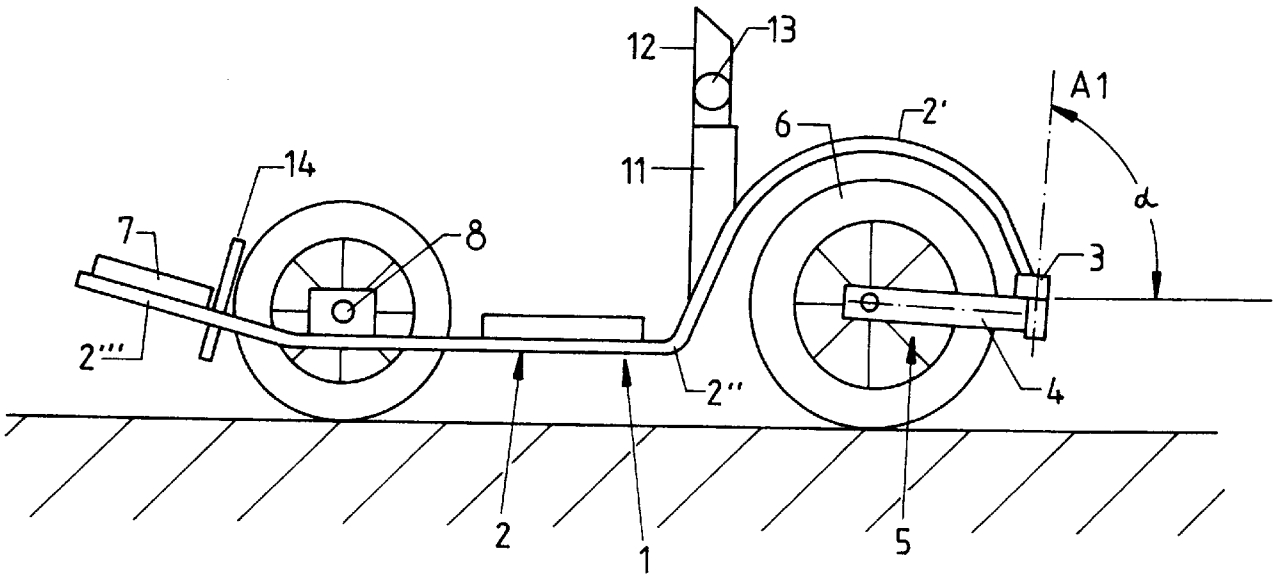
FIG. 1 shows in simplified form and in side view a first possible embodiment of the rolling device according to the invention.
Figure 2:
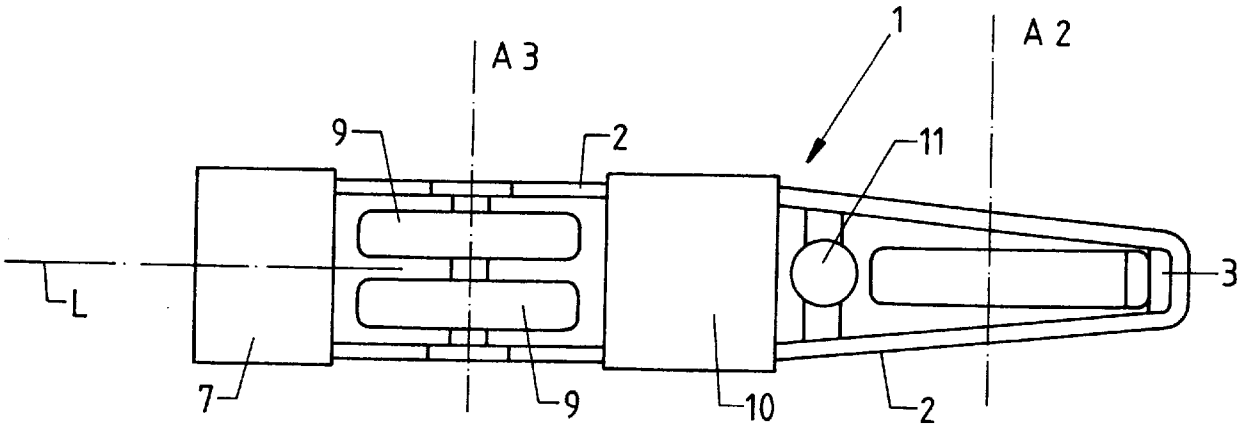
FIG. 2 shows a top view of the rolling device according to FIG. 1.
Figure 3:
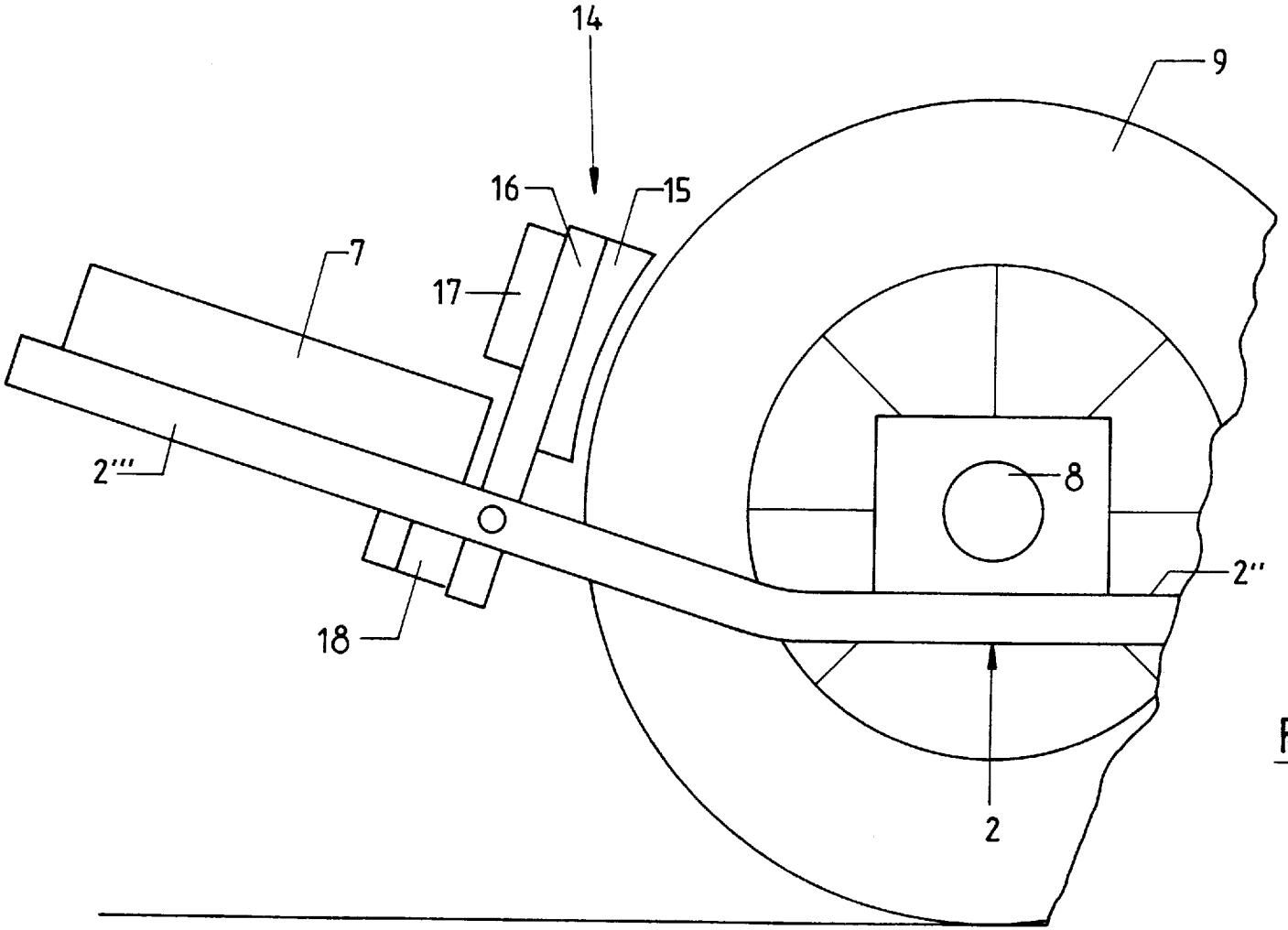
FIG. 3 shows in enlarged detailed form a brake for the rolling device according to FIG. 1.

The rolling device that is depicted in FIGS. 1–3 include an elongated frame 1, which in the embodiment shown includes two frame elements 2 that are each formed from lengths of a steel tube, which extend in the longitudinal direction L of the device, and thus of frame 1, and are also connected or bonded to one another via transverse struts made of the shaped tube.

At the front of frame 1, two frame elements 2 are run upward in the shape of an arc and then downward again in a section 2". At the free ends of frame elements 2, that are connected to one another, a bearing 3, on which a wheel fork 5 that comprises fork arm 4 is freely pivotable with its side facing away from the free ends of fork arm 4, specifically around an axle A1, which is attached to the front of the frame. Front wheel 6 of the device is freely rotatable, specifically around an axis that is perpendicular to axle A1, on fork arms 4.

Two frame elements 2 are also connected to the rear end of frame 1 that is at a distance from bearing 3. In addition, a first standing area 7 at the back is formed on frame 1, specifically by a plate that is attached above to two frame elements 2. On standing area 7 at the front end of the device, two rear wheels 9 are then freely and, independently of one another, rotatably mounted between the two frame elements on a shaft 8, which lies perpendicular to the longitudinal extension of frame elements 2 that are parallel there and is mounted at both ends respectively on a frame element 2. Two wheels 9 have the same diameter and a somewhat smaller diameter than front wheel 6 in the case of the depicted embodiment. On two wheels 9, a second standing area 10, which also is attached by one of frame elements 2 to the upper side, follows toward the front end of the frame, and the intermediate space between these spanning plates is formed. Section 2' begins on the side of standing area 10 that faces away from two wheels 9. As FIG. 1 shows, frame elements 2 run in a straight line in section 2" between shaft 8 and the transition to section 2". Standing area 10 is located in said section 2". As FIG. 1 shows, in addition, frame elements 2 form a section 2'" at the back end, at which these elements run obliquely upward and at which standing areas 7 are provided, so that the latter is inclined relative to the plane of standing area 10.

Axle A1 lies in a mid-plane that is arranged perpendicular to the imaginary mid-plane of standing areas 7 and 10 which encloses longitudinal axis L of the device, on which frame elements 2 are also designed as mirror images and with the imaginary plane of standing area 10 encloses an angle $\alpha$ of 90° or less than 90°, for example, an angle $\alpha$ of 90° or less than 90°, for example an angle $\alpha$ of 90–80°, which opens toward the front side of the device. In addition, axle A1 lies perpendicular to a plane that encloses the axle of wheel 6 and the longitudinal extension of fork arm 4. Between standing area 10 and the front of the device is also an attachment 11 for a bar 12, as is also used in surfboards and which has a universal joint 13 that allows it to pivot in all directions. In the area of standing area 7, a wheel brake 14 is provided which basically consists of a swivelling lever 16 that is provided with a brake rubber, which is provided to pivot on frame 1 around an axis that is parallel to the axis of shaft 8, projects with its end that has brake rubber 15 over standing area 7, and has a cushion 17 at its side that faces away from brake rubber 15 and thus also wheels 9, by which lever 16 can be pressed against the action of a return force which is produced by a rubber element 18 against wheels 9 for braking with the ankle of the foot placed on standing area 7.

To ride or roll-surf, the user stands with one foot each on standing area 7 or 10 in such a way that the two wheels 9 are between the feet and the body is positioned crosswise to longitudinal direction L. With the aid of rigging 12, propelling or roll-surfing in the wind is possible, whereby the rolling device can be steered by the user shifting his weight, specifically like when surfing with a surfboard in water.

Braking can then be done with the foot that rests on standing area 7.

The rolling device can also be used with a rigging, specifically, for example, for riding down sloping terrain, over a sloping path, etc. In addition, the device can be used as a roller, for which then a roller-handle is inserted into attachment 11 and secured appropriately.

Wheels 6 and 9 are in each case spoked wheels with pneumatic tires. Two wheels 9 ensure that the device can stand up straight on a flat surface, i.e., oriented with the mid-plane in the vertical direction to make it easier to get onto the device. By adjusting angle $\alpha$, the stability of the device can be maintained during straight travel.

Figure 4:
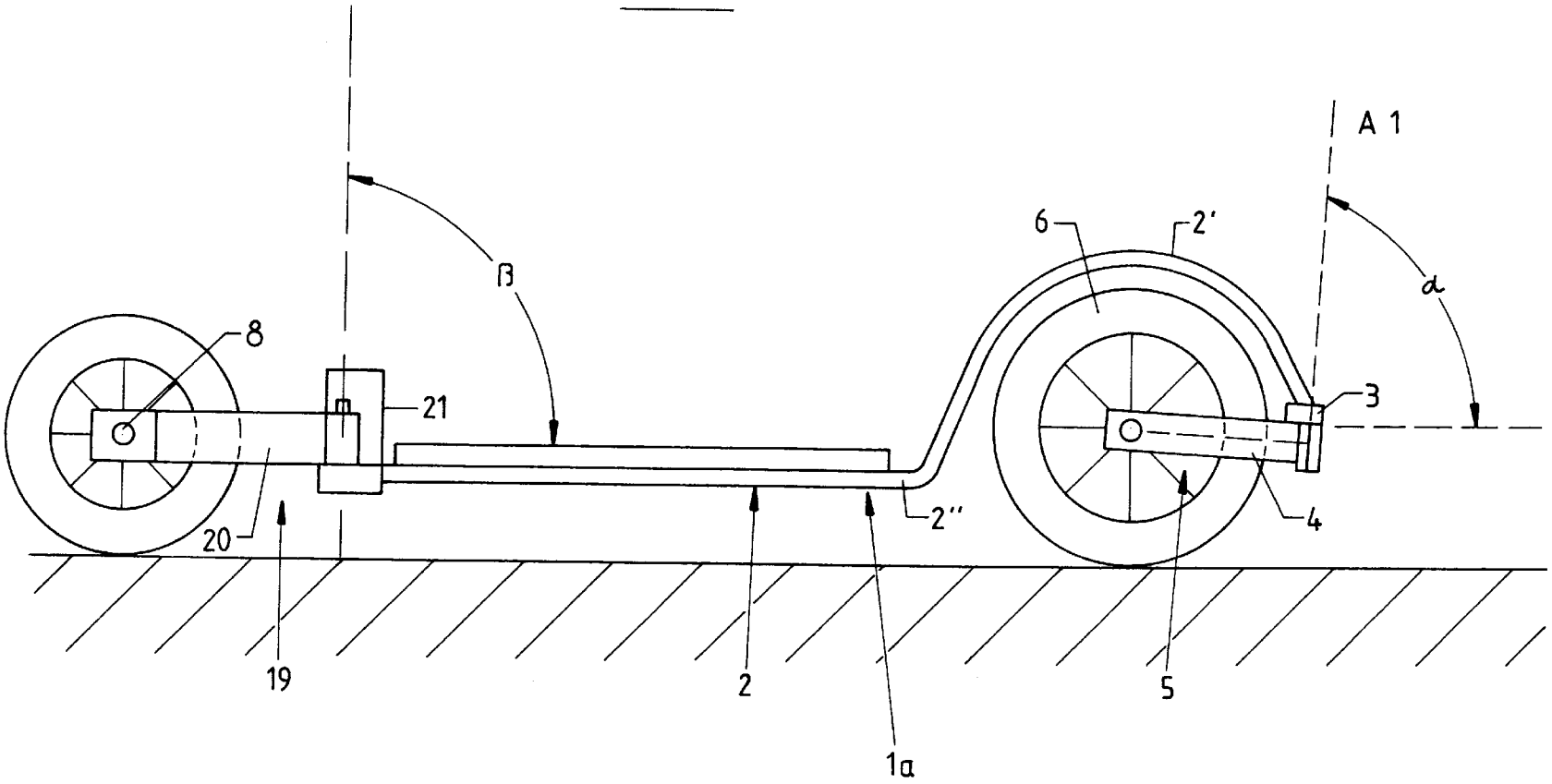
FIG. 4 in simplified form and in side view shows another embodiment of the rolling device according to the invention.

FIG. 4 shows in simplified form another possible embodiment of the rolling device according to the invention. This device consists of a frame 1*a*, which is designed to be basically identical to frame 1 of the device of FIGS. 1–3. On the front side of frame 1*a* is again front, steerable wheel 6 using a wheel support (wheel fork 5) that can be pivoted around axle A1. In the same way, a wheel fork 19 is provided on the rear end of frame 1*a* to pivot around an axle A4 which, like axle A1, is a vertical axis which lies in the vertical mid-plane that encloses longitudinal axis L of frame 1*a* and which, relative to the plane formed by both wheel axles A2 and A3, encloses an angle $\beta$ of 90° or less than 90° that opens toward the front of the device, i.e., for example, an angle $\beta$ in the range between 90° and 80°.

Wheel fork 19 also has two fork arms 20, which are connected to one another via a yoke section and support shaft 8 at their free ends, on which two rear wheels 9 are freely rotatable between two fork arms 20. To pivot around axle A4 on frame 1*a* or on a bearing 21 that is located there, wheel fork 19 is coupled to the yoke piece that connects two fork arms 20 to one another.

The distance between two wheels 9 in the direction of the axis of shaft 8 is also selected to be small in this embodiment so that it is possible to mount the device in a labile equilibrium on the ground via two wheels 9, but the device tips over and thus stops if the user leaves the device during use.

Standing area 7 at the back is omitted in this embodiment. Instead of standing area or standing plate 10, the device of FIG. 4 has a standing area 10*a*, which is larger in the direction of longitudinal axis L.

By adjusting angle $\beta$, the riding properties of the device can be altered, i.e., by reducing angle $\beta$, increasing stabilization of the steering of wheels 9 at the back is produced.

As FIG. 1 and FIG. 4 show, fork arms 4 or 20 of wheel forks 5 or 19 lie with their longitudinal extension respectively in a plane that is perpendicular to corresponding steering axle A1 or A4.

Figure 5:
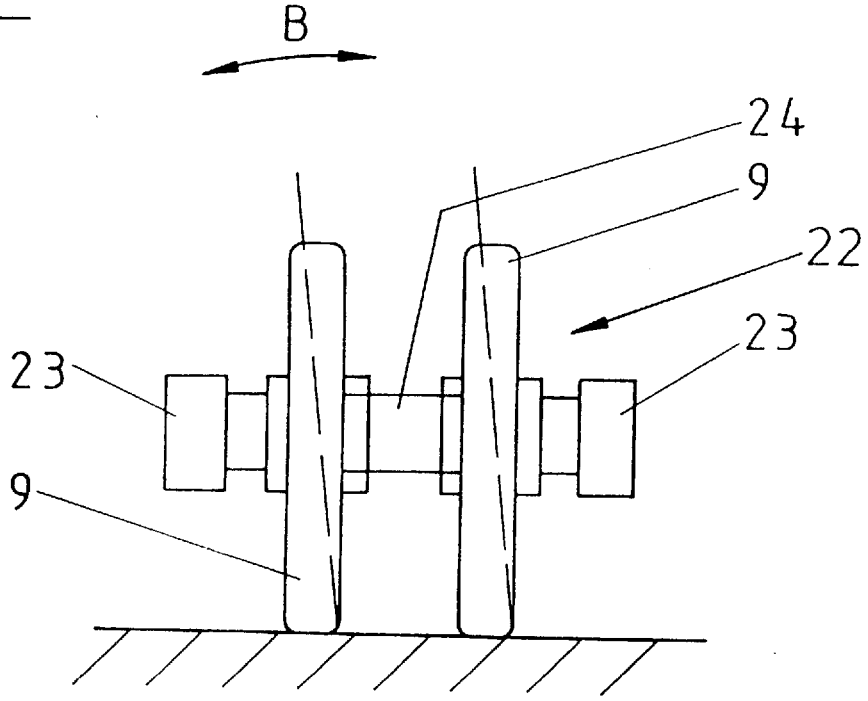
FIGS. 5–8 show in various forms different suspensions for the wheels at the back.

In enlarged detailed form, FIG. 5 shows another possible positioning for two wheels 9 at the back in such a way that these wheels, corresponding to double arrow B, in each case can execute a pivoting movement in respective wheel plane RE to a limited extent, specifically around an axis that is parallel to longitudinal axis L for a corresponding inclination of these wheels relative to the horizontal plane. For the above-mentioned purpose, wheels 9 are respectively mounted on a shaft 22, which is connected to frame 1 at both ends by means of a bearing 23 and which has the function of shaft 8. In its middle partial area 24, the shaft or axle 22 is made elastic, so that when this elastic area is deformed, two wheels 9 are able to tilt. Elastic area 24 is made from, for example, a block that consists of an elastomer or from a spring arrangement. Two bearings 23 are designed so that they allow the respective end of axle 22 to pivot around an axis that is parallel to longitudinal axis L of the rolling device and at least one bearing 23 also allows axle 22 to be displaced axially.

Figure 6:
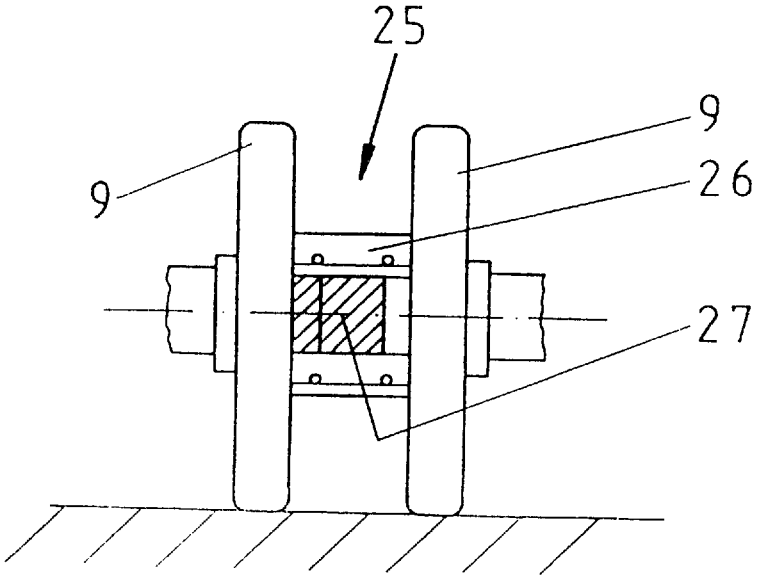

FIG. 6 shows an embodiment in which two wheels 9 at the back are mounted on an axle that forms a parallelogram arrangement 25 in its area 25 between wheels 9, which also allows wheels 9 or their wheel planes RE to pivot by a specified amount around an axle that is parallel to longitudinal axis L. The parallelogram arrangement that forms section 25 also has a return and damping element 27 that is made from an elastic body, for example from an elastomer, which is provided between two arms 26 that form parallelogram arrangement 25.

Figure 7:
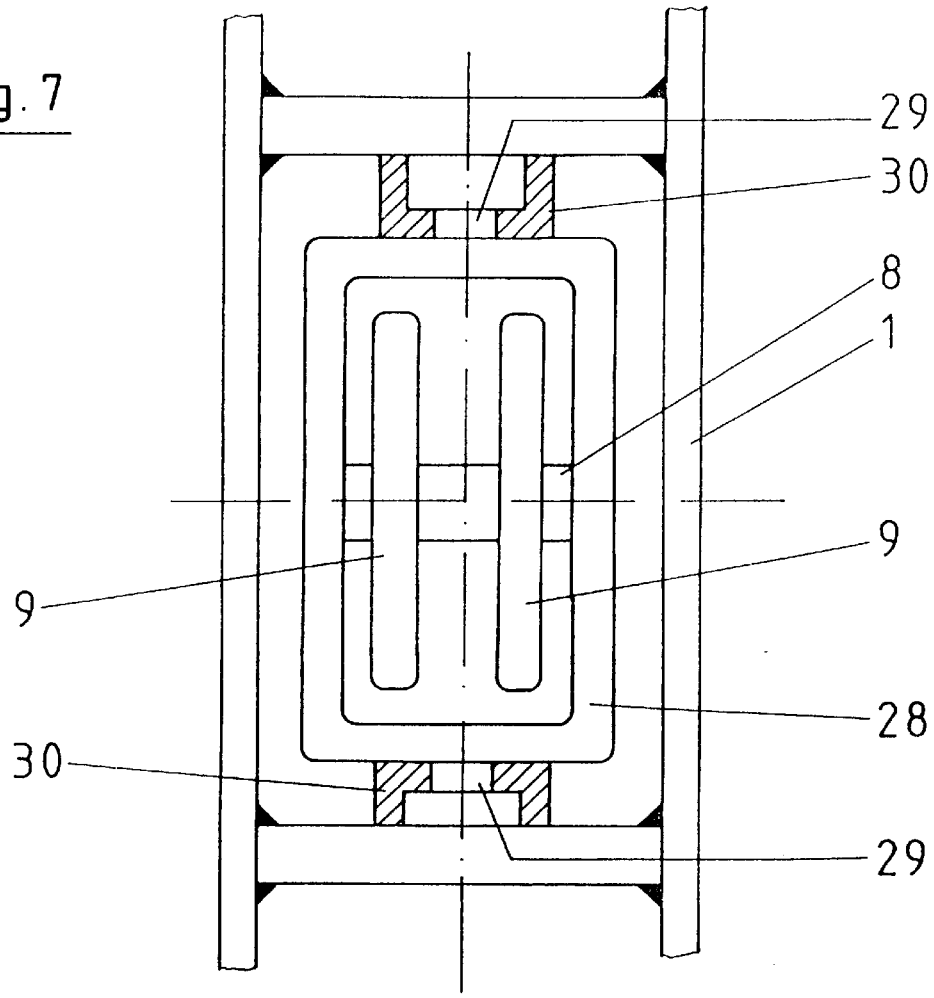

FIG. 7 shows in top view a suspension of wheels 8 and 9 at the back in the form that these wheels with their axles or shaft 8 are not mounted directly on frame 1, but rather on an auxiliary frame 28, which for its part is provided on frame 1 with the aid of pivot pins 29 to pivot around longitudinal axis L, whereby two pivot pins 29 are provided coaxially in each case on the front and on the back ends of auxiliary frame 28 and lie with their axle in a plane that is arranged cutting perpendicular to shaft 8 and between wheels 9. The pivot bearings that are formed by pivot pins 29 correspond in turn to return and damping elements which preload auxiliary frame 28 into an initial position, in which this auxiliary frame lies in a plane that is parallel to the plane of frame 1. In addition, it is also basically possible to design auxiliary frame 28 in an elastic manner.

Figure 8:
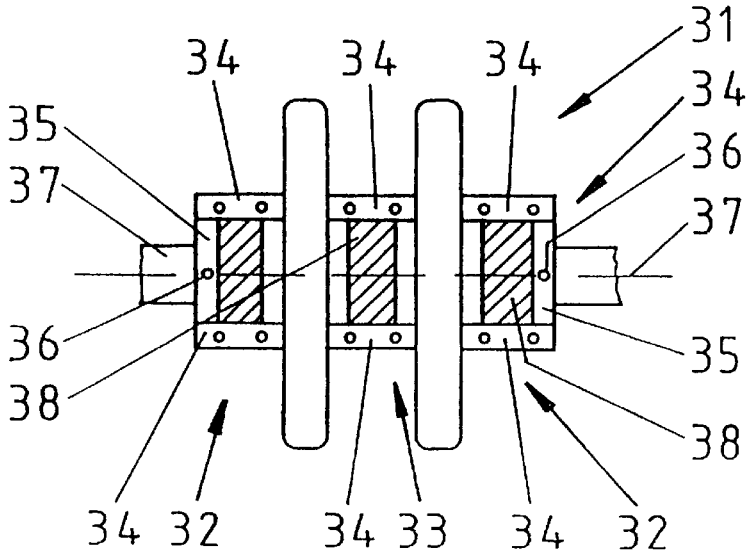

Finally, FIG. 8 shows an embodiment in which axle 31 which has two back wheels 9 in its partial area on both sides from wheels 9 and its partial area 33 between these wheels is designed in each case as a parallelogram, specifically with axes of rotation parallel to longitudinal axis L, whereby the parallelogram in each case comprises two parallelogram arms 34 that run in the axial direction of shaft 31, from which parallelogram arms 34 in sections 32 that lie in each case outside with a bearing element 35 are connected in a hinged manner, whereby said bearing element is provided on frame 1 or on a projection 37 to pivot around an articulated axle 36, while the other ends of parallelogram 34 in each case are connected to bearing elements around the axle parallel to the longitudinal axis, on which wheels 9 are rotatably mounted. A damping or return element 38 is in turn provided respectively between parallelogram arms 34.

By tilting wheels 9, reliable and basically exciting riding on sloping ground obliquely to the line of slope is possible.

A spring 39, with which front wheel 6 is rotated easily from the zero position of its steering, is indicated very diagrammatically as a functional element in FIG. 2. When getting off and riding or controlling the device, the force of this spring is easily overcome or neutralized by the user.

When jumping off of the device or in the event of a fall, a steering maneuver is performed at spring 39 in such a way that the device immediately swerves and then falls over. This also makes it possible to make the distance of rear wheels 9 adjustable in the axial direction, so that for beginners (also in the case of training), two rear wheels 9 of the base of the device is improved by the greater distance, without the necessary self-slowing or braking (by falling over) being lost in the event of a fall or during accidents.

Figure 9:
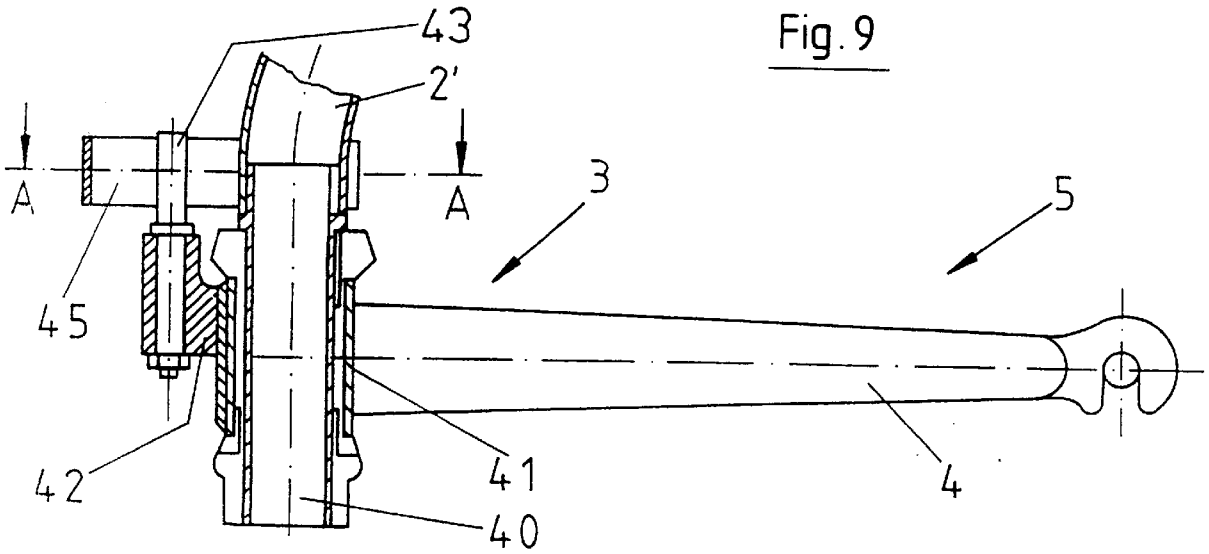
FIG. 9 and FIG. 10 show the universal joint or bearing of the wheel fork of the front wheel in vertical section and corresponding to a section A—A of FIG. 8.
Figure 10:
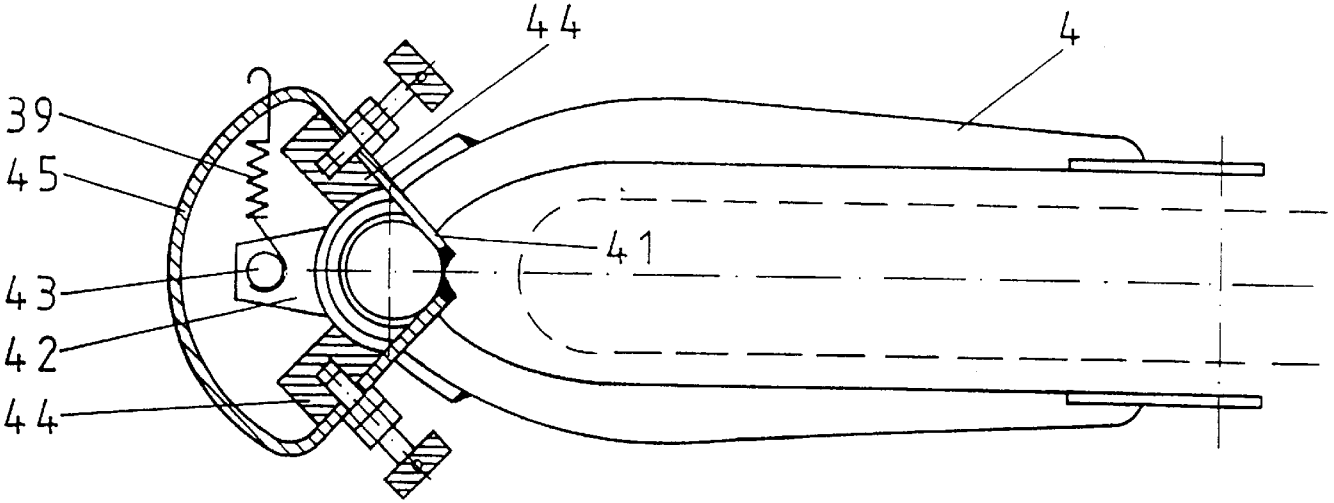

In FIG. 9 and FIG. 10, pivot bearing 3, with which wheel fork 5 is mounted on frame part 2', is depicted in more detail. This bearing basically consists of a pivot pin 40, on which a sleeve-like bearing element 41 of the wheel fork is mounted to pivot around axle A1. An extension 42, which is located over the side of articulated sleeve 41 facing away from fork arms 4 is attached to the articulated sleeve and has a pin or bolt 43, which works with buffers 44 to limit the steering angle of the front wheel, which are provided at frame element 2 or at a bracket 45 that is welded at both ends there. The buffers and thus also the maximum steering maneuver are adjustable in the depicted embodiment. Spring 39 acts between bracket 45 and pin 43.

Instead of rigging 12, guide rods 46 that are indicated in FIG. 2 can also be attached to frame 1 to make it possible to ride the skateboard like a roller, whereby guide rod 46 produces not the steering of front wheel 6, but rather in the embodiment depicted is attached rigidly to frame 1 and is used only as a holder for the user.

In addition, it is possible to design the rear wheel arrangement so that it has more than two wheels 9 that are adjacent to one another.

What is claimed is:

1. A rolling device comprising a frame, wheels that are provided on said frame and are freely rotatable around two wheel axles that are separated in a longitudinal direction of said frame and are partially steerable, at least one standing area that is provided between said two wheel axles at frame whereby at least a front wheel axle is designed as a steerable axle with a wheel suspension that is formed by a wheel fork comprising two fork arms and is freely rotatable on said frame or on a bearing that is located therearound a steering axle which runs perpendicular to said front axle, and whereby bearing moves ahead of said front axle in a travel direction of said rolling device, wherein a rear wheel arrangement is formed by at least two rear wheels that are offset relative to one another in a direction of their axle, said at least two rear wheels are directly adjusted to one another and have an axial distance between them that is smaller than the axial width that these wheels have at their periphery and wherein said at least two rear wheels are located at a center portion of said rear wheel axle, said at least two rear wheels are located inside said frame of said rolling device.

2. A rolling device comprising a frame, wheels that are provided on said frame and are freely rotatable around two wheel axles that are separated in a longitudinal direction of said frame and are partially steerable, at least one standing area that is provided between said two wheel axles at frame whereby at least a front wheel axle is designed as a steerable axle with a wheel suspension that is formed by a wheel fork comprising two fork arms and is freely rotatable on said frame or on a bearing that is located therearound a steering axle which runs perpendicular to said front axle, and whereby bearing moves ahead of said front axle in a travel direction of said rolling device, wherein a rear wheel arrangement is formed by at least two rear wheels that are offset relative to one another in a direction of their axle, wherein said steering axle is at an imaginary plane lying parallel to said two wheel axles and encloses an angle ($\alpha$) of less than 90° that is open toward a front of said rolling device.

3. A rolling device comprising a frame, wheels that are provided on said frame and are freely rotatable around two wheel axles that are separated in a longitudinal direction of said frame and are partially steerable, at least one standing area that is provided between said two wheel axles at frame whereby at least a front wheel axle is designed as a steerable axle with a wheel suspension that is formed by a wheel fork comprising two fork arms and is freely rotatable on said frame or on a bearing that is located therearound a steering axle which runs perpendicular to said front axle, and whereby bearing moves ahead of said front axle in a travel direction of said rolling device, wherein a rear wheel arrangement is formed by at least two rear wheels that are offset relative to one another in a direction of their axle, wherein said rear wheel axle is a steerable axle with a fork-like wheel suspension which is, freely rotatable on said frame around a steering axle that runs perpendicular to said rear wheel axle or on a bearing that is located there, which moves ahead of said rear wheel axle or rear wheel arrangement in the travel direction of said rolling device.

4. A rolling device comprising a frame, wheels that are provided on said frame and are freely rotatable around two wheel axles that are separated in a longitudinal direction of said frame and are partially steerable, at least one standing area that is provided between said two wheel axles at frame whereby at least a front wheel axle is designed as a steerable axle with a wheel suspension that is formed by a wheel fork comprising two fork arms and is freely rotatable on said frame or on a bearing that is located therearound a steering axle which runs perpendicular to said front axle, and whereby bearing moves ahead of said front axle in a travel direction of said rolling device in the direction of their axle, wherein a rear wheel arrangement is formed by at least two rear wheels that and offset relative to one another in a direction of their axle, wherein at least two rear wheels are pivoted by a specified amount around an axle that is parallel to the longitudinal axis of said frame.

5. A rolling device according to claim 4, wherein at least two rear wheels are pivoted parallel to one another around said axle that is parallel to longitudinal axis.

6. A rolling device according to claim 5, further comprising at least one return or damping element, which reloads said rear wheels into an initial position.

7. A rolling device according to claim 4 further comprising at least one return or damping element, which reloads said rear wheels into an initial position.

8. A rolling device comprising a frame, wheels that are provided on said frame and are freely rotatable around two wheel axles that are separated in a longitudinal direction of said frame and are partially steerable, at least one standing area that is provided between said two wheel axles at frame whereby at least a front wheel axle is designed as a steerable axle with a wheel suspension that is formed by a wheel fork comprising two fork arms and is freely rotatable on said frame or on a bearing that is located therearound a steering axle which runs perpendicular to said front axle, and whereby bearing moves ahead of said front axle in a travel direction of said rolling device, wherein a rear wheel arrangement is formed by at least two rear wheels that are offset relative to one another in a direction of their axle, further comprising a guide rod attached to said frame for use as a roller.

* * * * *